United States Patent [19]

Steffinger

[11] Patent Number: 4,641,908

[45] Date of Patent: Feb. 10, 1987

[54] RIGHT-ANGLED PLUG-TYPE CONNECTOR

[75] Inventor: Karl Steffinger, Munich, Fed. Rep. of Germany

[73] Assignee: Siemens Aktiengesellschaft, Berlin and Munich, Fed. Rep. of Germany

[21] Appl. No.: 691,623

[22] Filed: Jan. 15, 1985

[30] Foreign Application Priority Data

Jan. 27, 1984 [DE] Fed. Rep. of Germany ..... 3402902

[51] Int. Cl.[4] ..... H01R 13/502

[52] U.S. Cl. ..... 339/206 R; 339/17 LC; 339/176 M

[58] Field of Search ..... 339/206 R, 206 P, 176 M, 339/176 R, 176 MP, 17 R, 17 C, 17 LC

[56] References Cited

U.S. PATENT DOCUMENTS

| | | | |
|---|---|---|---|
| 2,995,617 | 8/1961 | Maximoff et al. | 174/153 R |
| 3,136,591 | 6/1964 | Just et al. | 339/176 M |
| 3,351,894 | 11/1967 | Kinkaid | 339/176 M |
| 3,601,762 | 8/1971 | Eshelman | 339/176 M |
| 3,629,809 | 12/1971 | Tillmann | 339/176 M |
| 3,745,515 | 7/1973 | Michaels | 339/206 P |
| 4,125,313 | 11/1978 | Sipp et al. | 339/176 M |
| 4,550,962 | 11/1985 | Czeschka | 339/17 LC |

FOREIGN PATENT DOCUMENTS

| | | | |
|---|---|---|---|
| 0201195 | 12/1966 | Sweden | 339/176 MP |
| 1011071 | 11/1965 | United Kingdom | 339/176 MP |

*Primary Examiner*—Gil Weidenfeld
*Assistant Examiner*—Thomas M. Kline
*Attorney, Agent, or Firm*—Hill, Van Santen, Steadman & Simpson

[57] ABSTRACT

A right-angled plug-type connector for a printed circuit board connection characterized by a flexible fixing plate being secured in a plate-shaped retaining member to extend at right angles to the retaining member and having a plurality of bores in a pattern corresponding to a pattern of bores in the retaining member to receive contact elements which have a right angle bend. To improve the guidance of the contact elements which extend past a first side of the fixing plate to form contact prongs, each of the bores has a tubular extension which extends from a second side of the fixing plate. The tubular extensions improves the guidance and positioning of each of the prongs to prevent skewing or misalignment during the forming of a plug connection.

4 Claims, 3 Drawing Figures

RIGHT-ANGLED PLUG-TYPE CONNECTOR

BACKGROUND OF THE INVENTION

The present invention is directed to a right-angled plug-type connector which includes a plate-shaped or strip-shaped retaining member which consists of an insulating material, has a plurality of parallelly extending bores which receive contact elements, and has a pair of spaced-apart projections extending from one side of the member. Each of the contact elements has a portion extending from the other side of the retaining member to form terminal portions and an angled terminal portion extending from the one side and through bores of a fixing plate, which is of an elastically yieldable material and is mounted by a snap fit in the projections of the retaining member to lie in a plane basically at right angles to said other side, to form prongs for connection to a circuit board.

The fixing plate provided in such plug-type connectors holds the angled terminal portion or section of the contact member with its bores, for example, in a desired pattern which may be a grid disposition of the bores of a printed circuit board so that the prongs or free ends of the angled terminal sections can be plugged in in an uncomplicated fashion into the grid bores of the printed circuit board when the plug connector is joined to a printed circuit board. Since the fixing plate must be flexed when it is secured to the actual housing or member of the plug-type connector in order to be inserted between the projections of the retaining member, it is desirable to design this fixing plate or member to be as relatively thin as possible. With the relatively thin design for the fixing plate, the guidance region defined by the length of the bores which is dependent on the thickness of the fixing plate is only relatively short. When one of the prongs of the angled terminal sections misses the allocated bore in the printed circuit board during joining of the plug-type connector to the printed circuit board, the corresponding terminal section will spring out of the fixing plate bore. Over and above this, an oblique attitude of the prongs of the angled terminal sections is promoted when the guide region of the fixing plates are only very short.

SUMMARY OF THE INVENTION

With a plug-type connector of the above-described type, it is therefore an object of the present invention to guarantee adequate long guidance regions for the angled terminal section without the elastic flexibility of the fixing plate being diminished.

To obtain this object, the present invention is directed to an improvement in a right-angled plug-type connector having a plurality of contact elements which are fixed parallel to one another in a desired pattern in bores in a plate-shaped retaining member, which is composed of insulating material and on one side has a pair of spaced-apart projections; and a fixing plate of an elastically yielding material having a plurality of bores extending from a first side to the second side in the desired pattern, said fixing plate being secured between said projections with a snap fit and with the first and second sides being substantially at right angles to the one side of the retaining member so that the bores of the fixing plate extend perpendicular to the bores of the retaining member, each of the contact elements having a right-angled terminal portion extending from said one side of the member and through one of the bores of the fixing plate to form a terminal or prong projecting from the second side of the fixing plate. The improvement comprises the fixing plate having means for improving the guidance of each of the angled terminal portions comprising a tubular extension for each of the bores of the fixing plate, said extension being integral with the fixing plate and extending from the first side thereof.

In this fashion, the flexibility of the fixing plate is more likely to be increased by means of the particularly thin design of the plate and the guiding function of the plate will not be reduced. In a further development of the invention, the bores in the fixing plate are provided in at least two rows which extend parallel to the retaining member. The row of bores closer to the retaining member will have tubular extensions which are of a shorter dimension in comparison to the tubular extensions of the row more remote to the retaining member so that a step-like configuration is provided. As a result of this length graduation of the tubular extensions, at least two rows of contact elements can be provided in the retaining member. Thus, the stepped length graduation of the tubular extension enables the seizing of the right-angled terminal sections of the contact elements immediately after the bend of each of these elements. Thus, an optimum straight line guidance of the angled or bent section can be obtained.

Finally, it can also be provided within the framework of the present invention that the free ends of each of the tubular extensions is provided with a funnel-shaped introduction formed by a chamfer around the bore. Thus, the bore in the tubular extension adjacent the free end diverges conically to form a countersink.

As a consequence of this design of the tubular extensions, the threading or insertion of the angled terminal sections into each of the tubular extensions of the fixing plate is particularly facilitated. This is of particular importance when a multi-pole, plug-type connector has a large number of contact elements which must be inserted into the corresponding number of bores in the fixing plate.

DESCRIPTION OF THE PREFERRED EMBODIMENTS

Figure 1:
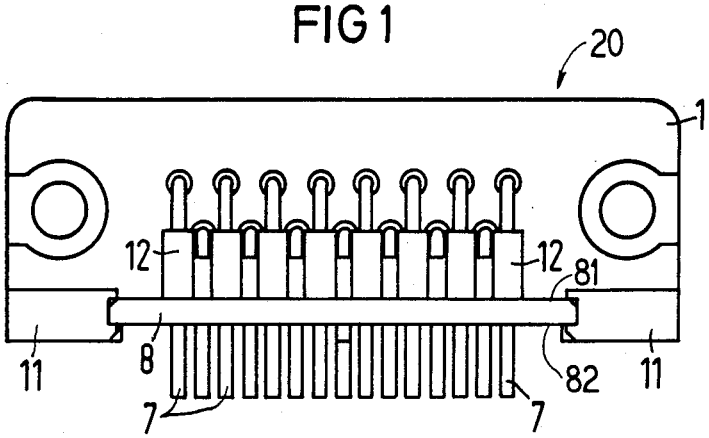
FIG. 1 is a back view of a right-angled plug-type connector in accordance with the present invention.

The principles of the present invention are particularly useful in a right-angled plug-type connector generally indicated at 20 in the Figures. As illustrated, the connector 20 has a retaining member 1, which is formed of two parts which are a plate-like part 21 that has a recess receiving a part 22. As illustrated, the retaining member from one side 5 has a plurality of bores extending therethrough and in communication with the other side 3. These bores, as illustrated in FIGS. 1 and 3, are arranged in two parallel rows with the bores of one row being offset from the bores of the other row.

The connector 20 includes a plurality of contact members or elements 2, which are received in the parallel rows of bores of the retaining member 1. As illustrated, each of the contact elements has a portion anchored in the bore and has portions extending from each side of the rectangular-shaped retaining member. As illustrated, a portion extending from the other side 3 forms contact pins 4 which are parallel to one another and extend from the retaining member 1. From the one side 5 of the retaining member, the contact members form wire-like terminal elements which have been bent at right angles to form terminal sections or prongs 7 which extend at right angles to the contact pins 4 and can be plugged into a corresponding pattern of bores of a printed circuit board.

Figure 2:
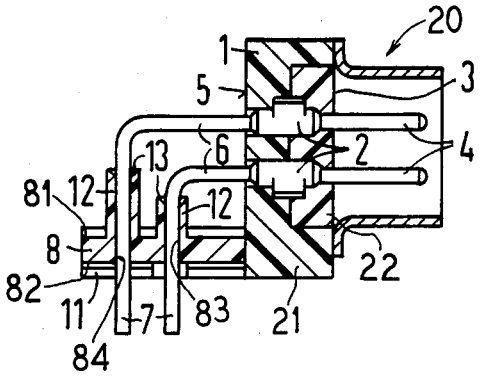
FIG. 2 is a transverse cross-sectional view with portions in elevation of the right-angled plug-type connector of FIG. 1.
Figure 3:
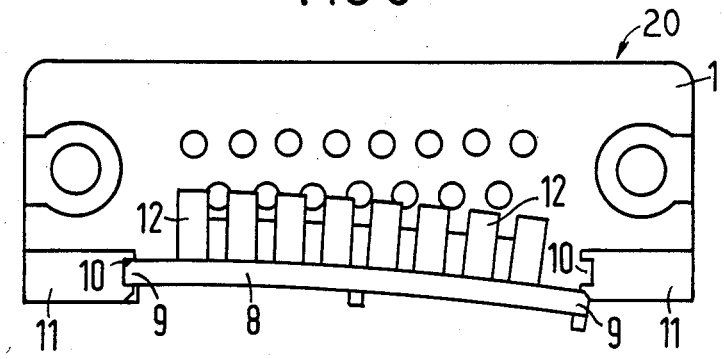
FIG. 3 is a back view of the right-angled plug-type connector similar to FIG. 1 without the contact elements being present and with the fixing plate only partially inserted in a retaining member of the connector.

In addition to the contact or terminal elements 6 extending from the one side 5 of the retaining member, the retaining member, particularly the portion 21, has a pair of projections 11 extending at right angles thereto with each of the projections having a groove or notch 10 (best illustrated in FIG. 3). A fixing plate 8 is provided in order to be able to hold the angled terminal sections of the terminal elements 6 in the particular pattern of the bores for the printed circuit board. The fixing plate 8 is formed of an elastically yieldable material and is thus very flexible. It is inserted or secured to the retaining means by a snap fit with ends 9 being received in the grooves 10 of the projections 11. Thus, the fixing plate 8, which is substantially a thin rectangular member having a first side 81 extending parallel to a second side 82, is mounted with the first and second sides extending substantially at right angles to the side 5 of the retaining member. As best illustrated in FIG. 2, the fixing plate 8 has two rows of bores 83 and 84 which extend at right angles to the first and second sides or surfaces 81 and 82. In addition, each of the bores of the rows 83 and 84 have a tubular extension 12 which extends from the first side 81 of the plate 8. The prongs or terminal portions 7 of each of the angled portions 6 extend through the bores and project from the second side 82 to be received in the corresponding bores of the circuit board. The tubular extensions 12 form means for improving the guidance of the angled sections or portions 6. It should be noted that the bores in the rows 83 and 84 are arranged in the same pattern as the bores in the retaining element 20 and also the pattern of the bores or sockets in the circuit board (which is not illustrated).

To facilitate the insertion of the prongs 7 through the bores of the tubular extensions 12, it is noted that the free end of each of the tubular extensions 12 is formed by a countersink or funnel-shaped introduction chamfer. In addition, it is noted that the tubular extensions 12 associated with the row 83, which is nearest the retaining member 1 has a lower or smaller height than the tubular extensions 12 associated with the row 84. Thus, the tubular extensions of the two rows have a stepped configuration, which enables providing a maximum amount of guidance for the particular element received in that row without interfering with the other row. It is also noted that the longer angled portion of the upper row of the retaining member 1 has a greater amount of guidance due to the increased length of the tubular extensions associated with the row 84. As a result of the guidance region, which is created in the tubular extensions 12 in such a fashion as to match the respective lengths of the angled terminal portions or prongs 7, undesirable skewing of the angled terminal portions or prongs 7 is reliably prevented. Moreover, it is impossible for the prongs 7 to spring out of their respective guidance regions in the fixing plate 8.

Although various minor modifications may be suggested by those versed in the art, it should be understood that I wish to embody within the scope of the patent granted hereon, all such modifications as reasonably and properly come within the scope of my contribution to the art.

I claim:

1. A right-angled plug-type connector having a plurality of contact elements which are fixed parallel to one another in a desired pattern, said connector comprising a plate-shaped retaining member being composed of insulating material and having a pair of spaced-apart projections extending from one side thereof, said projections having facing grooves, said retaining member having a plurality of through bores being arranged in a desired pattern; a plurality of contact elements being fixed in said pattern of through bores of the retaining member, each of said contact elements having a right-angled terminal portion extending from said one side of the retaining member; and a fixing plate of elastically yieldable material having a plurality of bores extending from a first side to a second side in the desired pattern, said fixing plate having a tubular extension for each of the bores of the fixing plate, each extension being integral with the fixing plate and extending from the first side thereof, said fixing plate being received between said projections the first side adjacent said one side and with the ends of the fixing plate in said grooves by flexing said plate in order to be inserted between said projections with a snap fit with the tubular extensions and bores of the fixing plate being arranged to extend perpendicular to the through bores of the retaining member and with the terminal portions of the contact elements being inserted through the tubular extensions and their associated bores in the fixing plate to form prongs projecting from the second side of the fixing plate and at right angles to the through bores of the retaining member.

2. A right-angled plug-type connector according to claim 1, wherein each of the bores at a free end of the tubular extension has a diverging taper to form a funnel-shaped introduction to facilitate the insertion of the prong of the contact element therethrough.

3. A right-angled plug-type connector according to claim 1, wherein the bores in the retaining member are arranged in at least two parallelly extending rows and the bores in the fixing plate are arranged in two parallel rows and wherein the tubular extensions for the row of bores of the fixing plate closest to the retaining member have a lesser height than the tubular extensions for the row more remote from the retaining member so that the rows of tubular extensions have a stepped configuration.

4. A right-angled plug-type connector according to claim 3, wherein each of the bores at the free end of the tubular extension has a diverging taper to form a funnel-shaped introduction to facilitate the insertion of the prong of the contact element therethrough.

* * * * *